US010422605B2

(12) United States Patent
Shapiro

(10) Patent No.: US 10,422,605 B2
(45) **Date of Patent: *Sep. 24, 2019**

(54) LAUNCHING DEVICE

(71) Applicant: Imperial Toy LLC, North Hills, CA (US)

(72) Inventor: Ami N. Shapiro, Granada Hills, CA (US)

(73) Assignee: Imperial Toy LLC, North Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/937,540

(22) Filed: Mar. 27, 2018

(65) Prior Publication Data

US 2018/0321009 A1 Nov. 8, 2018

Related U.S. Application Data

(63) Continuation of application No. 15/275,295, filed on Sep. 23, 2016, now Pat. No. 9,927,203.

(51) Int. Cl.
*F41B 3/02* (2006.01)

(52) U.S. Cl.
CPC ..... *F41B 3/02* (2013.01)

(58) Field of Classification Search
CPC ..... F41B 3/02; F41B 3/005
See application file for complete search history.

(56) References Cited

U.S. PATENT DOCUMENTS 2,735,417 A * 2/1956 Denekar ..... F41B 3/02 124/20.1
3,749,075 A * 7/1973 Saunders ..... F41B 3/02 124/20.1
3,865,094 A * 2/1975 Sweeney ..... F41B 3/02 124/20.1
3,875,923 A * 4/1975 Horel ..... F41B 3/02 124/20.1
3,901,209 A * 8/1975 Woolsey ..... F41B 3/02 124/20.1
3,918,427 A * 11/1975 Turner ..... F41B 3/02 124/16
3,974,820 A * 8/1976 Ott ..... F41B 3/02 124/20.1

(Continued)

OTHER PUBLICATIONS

"How to Use Your Kaos Bow," https://www.youtube.com/watch?v=u-L9ahj2Wy0 (2015).

*Primary Examiner* — John A Ricci
(74) *Attorney, Agent, or Firm* — Snell & Wilmer L.L.P.

(57) ABSTRACT

Devices for launching objects have a bow structure including a first structural element having a handle and a pair of risers extending outwardly from the handle. A second structural element extends outwardly and away from the handle and has a support member positioned to rest against a forearm of a user. A pouch is movably attached to the bow and is configured to accommodate placement of a desired object to be launched therein. One or more elastomeric bands extend between the pouch and peripheral ends of the first and second risers and thereby attach the pouch to the bow and operate to provide an energizing force when stretched to launch an object within the pouch. In an example, the object to be launched is a water balloon that is at least about 50 percent disposed within the pouch when in a pre-launch state.

20 Claims, 10 Drawing Sheets

(56) References Cited

U.S. PATENT DOCUMENTS

| | | | | | |
|---|---|---|---|---|---|
| 4,240,396 | A * | 12/1980 | Randoll | F41B 3/02 | 124/17 |
| 4,922,884 | A * | 5/1990 | Ford | F41B 3/02 | 124/20.1 |
| 7,861,700 | B2 * | 1/2011 | Scoggins | F41B 3/02 | 124/20.1 |
| 9,927,203 | B1 * | 3/2018 | Shapiro | F41B 3/02 | |

* cited by examiner

LAUNCHING DEVICE

CROSS-REFERENCES TO RELATED APPLICATIONS

This patent application is a continuation of and claims priority to U.S. patent application Ser. No. 15/275,295 filed Sep. 23, 2016, now U.S. Pat. No. 9,927,203 issued Mar. 27, 2018, which application is herein incorporated by reference in its entirety,

FIELD

Launching devices are described herein for use in launching desired objects towards an intended target and, more particularly, are engineered and configured to facilitate launching of water balloons towards an intended target.

BACKGROUND

Conventionally, water balloons or water bombs are in the form of a latex rubber balloon filled with a sealed volume of water. A feature of such conventional water balloons is that once they hit a target the force of the impact causes the latex rubber body to break, thereby causing the volume of water to escape and to wet the target. As a result, the act involving the throwing of such water balloons at targets, which many times are people, results in wetting the target and is the source of entertainment and fun, and a field of such play has evolved around water balloons.

As noted, water balloons are typically thrown or lobbed by a user at an intended target. Because water balloons, by nature, have an amorphous and changing shape, it is often difficult to accurately aim and throw a water balloon a particular distance and actually hit an intended target. This difficulty is compounded by the fact that the act of throwing the water balloon alone can cause the latex rubber body or skin to break as a result of the force of acceleration by the throwing source, e.g., a person's hand. This effect, along with the unlikelihood of accurately aiming and launching the water balloon, is more likely to occur when the intended target is located a distance outside of one's throwing range.

Various devices have been developed to allow a user to lobby water balloons at greater distances and hit the intended target at greater accuracy. One such device is a water balloon sling shot, which typically comprises a soft pocket in which the water balloon is placed, and an elastomeric material on either sides of the pocket. The Y-shaped frame, typical of the traditional slingshots, is usually omitted so as to accommodate a variety of water balloon shapes and sizes. As a result, the operation of a water balloon slingshot may require up to three people to launch a balloon, with two people holding the two ends of the elastomeric material, and one person to retract the pocket and water balloon into a launching position.

Accordingly, there exists a need to develop a device capable of launching a water balloon that will avoid the undesired effects noted above, while also enabling operation by single person.

SUMMARY

Devices for launching objects as disclosed herein comprise a bow structure that includes a first structural element comprising a handle positioned along a middle section of the element, and first and second risers extending outwardly in respective opposite directions from the handle. In an example, the handle may project outwardly a distance perpendicular to the first and second risers. In an example, the first and second risers are integral with the handle to form a one-piece construction. In an example, the first and second risers project in a frontwards direction away from the handle, and wherein ends of each first and second riser are oriented outwardly in a direction perpendicular to the handle. In an example, the first and second risers project in a frontwards direction away from the handle having a degree of departure than about 90 degrees as measured relative to an axis running parallel through the handle between the risers. In an example, each of the first and second risers comprise first and second sections, each having a different angle of departure as measured against an axis running through the handle between the risers.

A second structural element extends outwardly and away from the handle and has a support member at an end thereof to rest against a forearm of a user when the user grasps the device for use. In an example, the second structural element comprises a pair of arms extending outwardly away from opposed ends of the handle and that connect with the support member that is interposed between the pair of arms. In an example, the support member is configured to surround a forearm portion of a user's arm. A pouch is movably attached to the bow and is configured to accommodate placement of a desired object to be launched therein.

One or more elastomeric bands extend between the pouch and ends of the first and second risers and thereby attach the pouch to the bow. In an example, the pouch may be formed from fabric, wherein the device comprises two elastomeric bands, and wherein a first elastomeric band is used to connect one section of the pouch to the first riser end and a second elastomeric band is used to connect an opposite section of the pouch to the second riser end. In an example, the ends of each of the first and second risers are turned outwardly perpendicular to the handle a distance sufficient for the pouch to clear the handle when the device is moved from a first pre-launch to second launched position, and wherein the first and second riser ends are configured with attachment points for the one or more elastomeric bands. In an example, the ends of the first and second risers are configured having one or more openings therethough for accommodating placement of a respective elastomeric band therein. In an example, the object to be launched is a water balloon, the water balloon is disposed within the pouch, and wherein the pouch is configured to accommodate great than about 50 percent of the total surface area of the water balloon therein.

Launching devices as disclosed here may be used to launch a desired object according to the following method comprising placing a water balloon into the pouch such that at least 25 percent of the total surface area of the water balloon is contained within the pouch. The handle of the bow is then grasped in one hand such that the support member of the second structural element contacts a portion of the same arm that is used to grasp the handle. The pouch is pulled away from the handle so as to energize the elastomeric bands and place the pouch and water balloon contained therein into a lunching position or pre-launch state. The pouch is released, causing the pouch and the water balloon to be launched outwardly and away from the bow by the elastomeric force of the elastomeric bands.

BRIEF DESCRIPTION OF THE DRAWINGS

These and other features and advantages of water balloon launching devices as disclosed herein will be appreciated as the same becomes better understood by reference to the following detailed description when considered in connection with the accompanying drawings wherein.

DESCRIPTION

Figure 1:
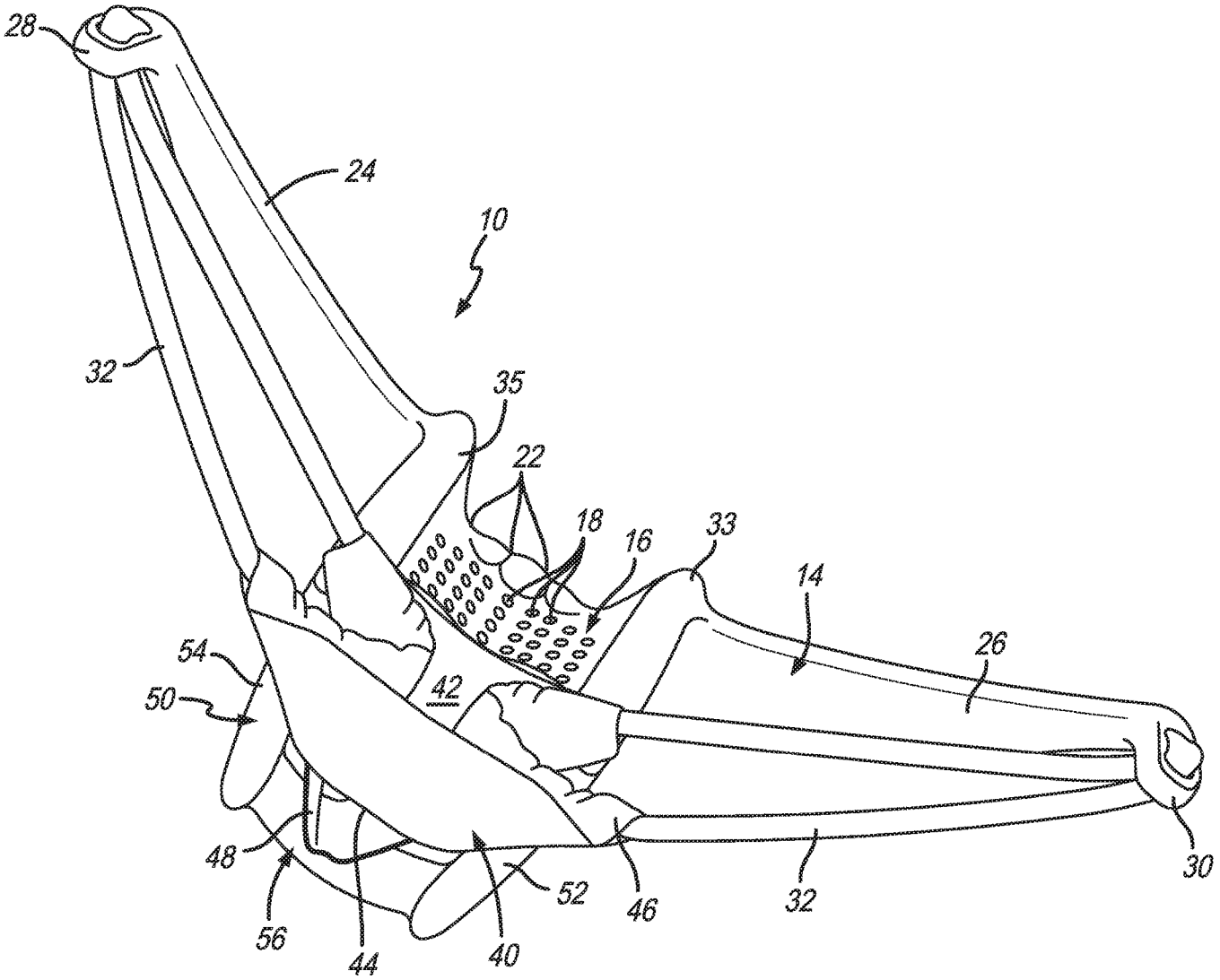
FIG. 1 is a side perspective view of an embodiment of a launching device as disclosed herein.
Figure 2:
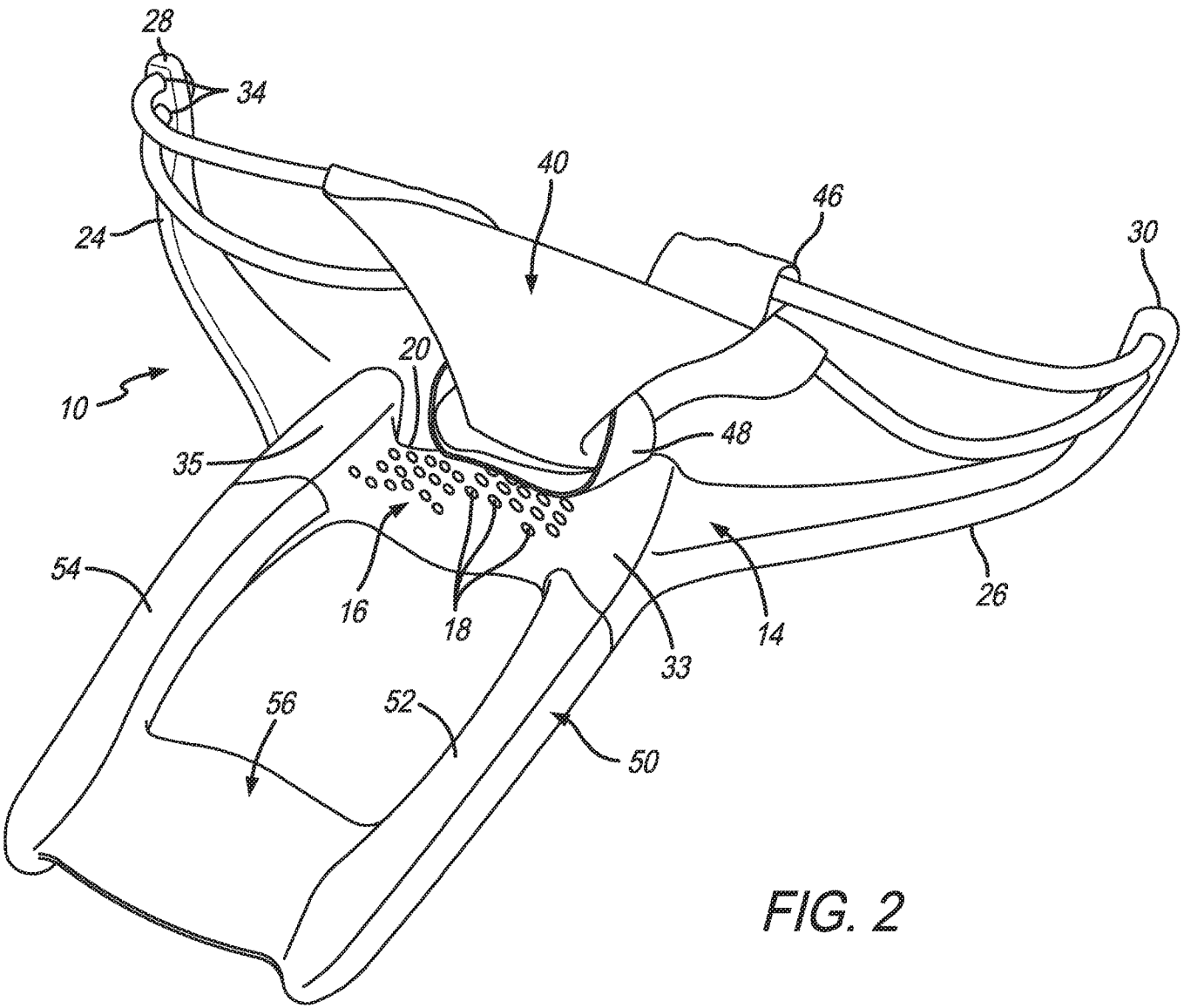
FIG. 2 is a first side view of the launching device of FIG. 1.
Figure 3:
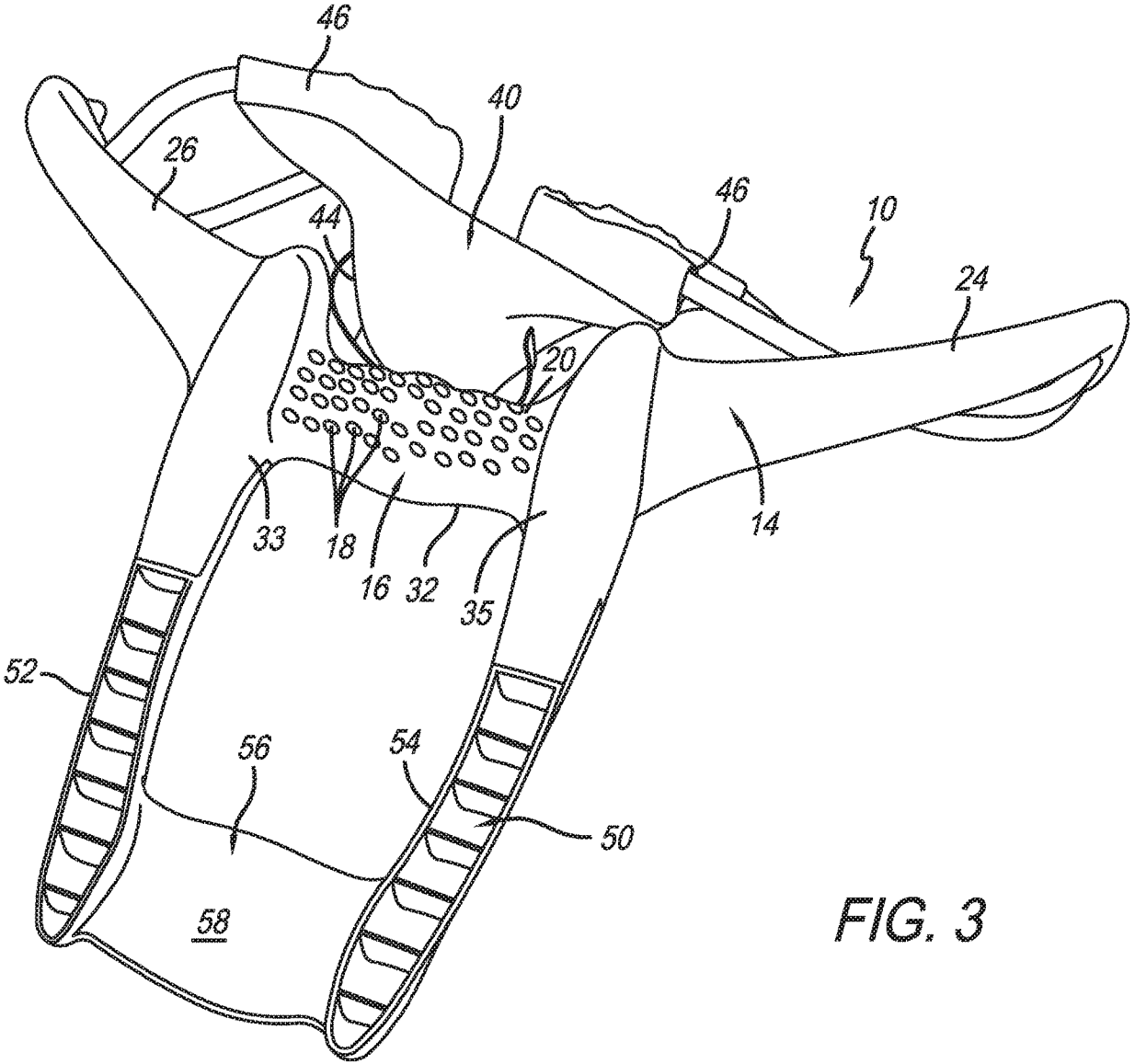
FIG. 3 is a second side view of the launching device of FIG. 1.

Launching devices as disclosed herein are in the form of a bow configured to launch a variety of objects and, in an example embodiment, are configured to launch water balloons by a singer user or person. The bow includes a first structural element with a handle element and risers extending outwardly therefrom. The first structural element may be configured to permit operation in a vertical or horizontal orientation depending on the particular embodiment. A second element is connected with the first element and includes a support member designed to provide stability for the first element and includes a member for resting or placement against and/or around a portion of a user's fore arm when operating the device. The first and second members may be configured to permit operation of the device in a vertical or horizontal orientation depending on the particular embodiment. Elastomeric bands are connected between each of the risers and a centrally-position pouch that is specially configured to accommodate a water balloon therein for launching from the device. The device is moved from a loaded state, where a water balloon is disposed within the pouch, to an activated state for launching by retracting the pouch containing the balloon away from the risers, causing the elastomeric bands to stretch into an energized state. The water balloon is launched from the device by releasing the pouch, wherein the pouch and its contents are moved towards the risers and away from the device by contraction of the elastomeric bands to a relaxed state.

FIGS. 1 to 4 illustrate an embodiment of the launching device 10 as disclosed herein comprising a bow configuration or structure having a first structural element 14 that includes a handle 16 positioned centrally in the first structural element and that is configured to be held or grasped within the hand of a user for holding onto the device 10 during use. The handle 16 may include surface features 18 for improving the interface or grip of the handle 16 within a user's hand, e.g., to reduce or prevent slippage. In an example, the surface features 18 may be provided in the form of a plurality of projections, e.g., circular in shape, extending outwardly from the handle a short distance. The handle 16 may also be configured having a forward surface 20 with one or more recessed sections 22 corresponding to the placement location of a user's fingers when grasping the handle. In an example, four recessed sections may be provided.

Moving outwardly away from opposed axial ends of the handle 16, the first structural element 14 comprises risers 24, 26 that extending outwardly away from each of the respective handle ends in symmetric fashion. Each of the risers 24, 26 project in a frontward direction moving away from the handle 16, and extending to respective peripheral riser ends 28, 30. In an example, the risers extend in a frontward direction, e.g., having an angle of departure as measured from an axis running parallel through the handle greater that is from about 0 to 90 degrees. In an example, the angle of departure of the risers is between about 5 to 90 degrees, 20 to 80 degrees, 30 to 60 degrees, 45 to 75 degrees, and in the particular example of FIGS. 1 to 4 is about 30 degrees. It is desired that the risers have such a forward directed degree of departure relative to the handle because it results in a longer pull and greater energizing of the elastomeric bands to provide increased launching velocity and greater distance of travel for the launched object.

In an example, the risers 24, 26 have a length as measured between respective opposed handle ends and the riser peripheral ends 28, 30 that is equal to or greater than the length of the handle, greater than the handle. In an example, each riser has a length that is between about 0.5 to 1 to 4, 1 to 3, 1.2 to 2.5, and in the particular example of FIGS. 1 to 4 is about 1.2 to 2 times the length of the handle. In a particular example, the handle may have a length of approximately 3.25 inches, and the tip-to-tip distance between the riser ends 28 and 30 is approximately 15.25 inches, so each riser 24 and 26 has a length of approximately 6 inches, which is about 1.85 times the handle length. The risers having such a length is desired because it results in desired length of the elastomeric bands that operate to accommodate a stretching distance of 3 to 4 feet, which is within a range that an average person can physically pull.

Figure 4:
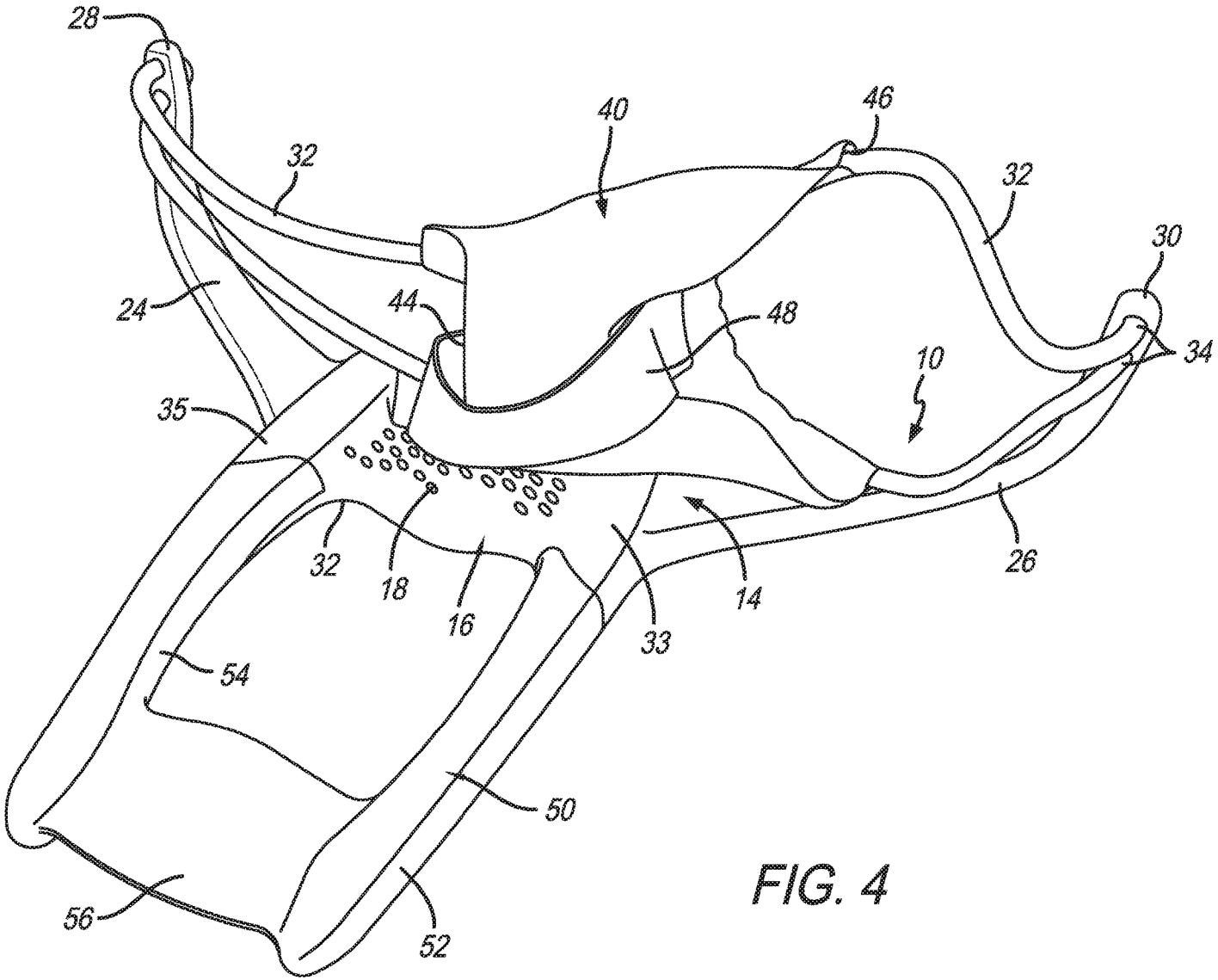
FIG. 4 is a side perspective view of a riser of the launching device of FIG. 1.

As best illustrated in FIG. 4, as noted above, each of the risers 24, 26 include respective peripheral ends 28, 30 that in an example depart outwardly from the remaining portion of the risers. In an example, the riser peripheral ends 28, 30 depart at an angle of approximately 90 degrees relative to an axis running along a remaining portion of the risers. A feature of positioning the riser peripheral ends in such a manner is to provide an attachment position for an energizing means 32 used to facilitate launching of water balloons. Further, it is desired that the peripheral ends extend a sufficient distance away from the remaining portion of the respective risers 24, 26 and the handle 16 so as to ensure that adequate clearance is created between the handle and the pouch so that the pouch and its contents travels clear of the handle when released from a prelaunch state.

In an example, the riser peripheral ends are configured to orient the energizing means in a direction parallel to the axis running through the handle. In an example, each of the riser peripheral ends include an attachment feature 34 configured to facilitate attachment or connection of the energizing means thereto or therewith. In an example, where the energizing means is in the form of one or more elastomeric bands, the attachment feature may be provided in the form of one or more openings 34 through each of the riser peripheral ends. In the example illustrated, where the energizing means is provided in the form of elastomeric band 32 that each loop around respective riser peripheral ends, the attachment feature is provided in the form of a pair of openings 34 to accommodate placement of the bands therethrough such that the band is retained within the peripheral end by being looped over a portion of the end between the openings 34.

The energizing means or member 32 is used to connect each of the riser peripheral ends 28, 30 to a pouch 40 that is configured to accommodate placement of a desired object to be launched therein. In an example, the desired object is a water balloon and the pouch 40 is configured having an opening 42 at a forward portion that extends in a rear ward direction to pouch closed end 44. In an example, the pouch 40 is configured to contain at least a partial portion or volume of a water balloon therein, which partial portion is functionally sufficient to permit operating the device to launch the water balloon without the water balloon falling out of the pouch by force of gravity. In an example, the pouch is configured accommodate from about $1/3^{rd}$ to a complete diameter of the water balloon therein. In an example embodiment, the pouch may be formed from a fabric material that is sewn or otherwise joined as necessary to provide the closed end 44 having a depth as measured from the opening 42 to accommodate the desired diameter or volume of the object to be launched therein. Alternatively, the pouch may be formed from a plastic or other material that may be molded or otherwise configured to provide the desired functional shape.

In an example, the pouch 40 is also configured to provide attachment points for the elastomeric bands 32. In an example, the pouch 40 includes openings 46 extending along opposed sides of the pouch adjacent the opening 42 to accommodate placement of a portion of the bands therethrough. In the embodiment where the pouch is formed from a fabric material, the openings may be formed by sewing together side portions of the pouch to encapture or surround a desired length of the bands therein. In an embodiment where the pouch is formed from another material, the attachment points for the band may be configured as needed to function in a manner intended to provide a desired attachment with the bands. The pouch 40 may also be configured to include a feature 48 for retracting and holding the pouch and its contents in a pre-launch state where the elastomeric bands are energized. The feature 48 can be provided in the form of a strap or the like extending outwardly from a surface of the pouch closed end 44 for holding between one's fingers and/or for inserting fingers therein to retain the pouch and its contents in a pre-launch state. I an example, the strap 48 is provide in the form of a loop extending from the pouch closed end 44 to provide sufficient room for inserting one or more fingers therein in a holding or retaining manner. It is to be understood, that the retaining feature can be embodied differently that as described or illustrated, and function to retain the pouch while being within the scope of the device as described herein.

While a particular embodiment of the device has been described and illustrated as comprising a pair of looped elastomeric bands and pouch accommodating attachment with the same therethrough, other embodiments are within the scope of the device that may make use of a one, two or multiple elastomeric bands or spring members on each side extending from respective riser peripheral ends to the pouch, wherein the attachment configuration of the pouch with such differently configured elastomeric bands or spring members may also be different. A feature of the elastomeric bands, spring members, and the attachment configuration with the risers and pouch is that such be provided in a manner that promotes movement of the pouch and its contents from a prelaunch state to a launched state such that the open end of the pouch continues to face forward and not twist or otherwise rotate, which could interfere with the desired release and deliver of the contents within the pouch from the device. A feature of the pouch is that it be configured to accommodate a balanced placement of the water balloon therein, and that its attachment with the elastomeric bands provide a movement of the pouch and its contents in a balanced manner so as to promote the desired objective of launching a water balloon towards a desired target in a manner having a degree of accuracy without causing the water balloon to burst before impacting the desired target. The embodiment as described and illustrated is one that ensures that the open end of the pouch and its contents during launch and through release from the device remains in a front facing position to promote an effectively balanced forward directed release and delivery of the contents within the pouch toward the intended target.

Launching devices as disclosed herein include a second structural element 50 that extends from the first structural element 14. In an example, the second structural element 50 extends outwardly in a direction away from the handle backside surface 32. In an example, the second structural member may be releaseably attached with the first structural member 14 to promote storage and travel, e.g., by cooperating tongue and grove attachment features or the like. Alternatively, the first and second structural elements may be provided in the form of an integral one-piece construction. In an example, the first and second structural elements are each formed from plastic, have a generally hollow constructions, and are provide in the form of two separate elements that may be connected together prior to use.

In an example, the second structural element 50 comprises a pair of opposed arms 52, 54 each extending manner parallel with one another connecting with the first structural element 14 adjacent the handle ends 33 and 35 at the handle backside surface 32. In an example, the opposed arms 52, 54 extend from the first element to a support member 56 that extends in perpendicular fashion from and connects the two arms together. The support member 56 may be shaped having a curved or contoured surface 58 so as to accommodate placement against a forearm portion of a user's arm during use of the device to steady the device during launching activation. In an example embodiment, the launching device 10 has a symmetric configuration when taken along a plane or section running perpendicular through the handle 16 and support member 56 to promote use of the device by both left-handed and right-handed users.

Figure 5:
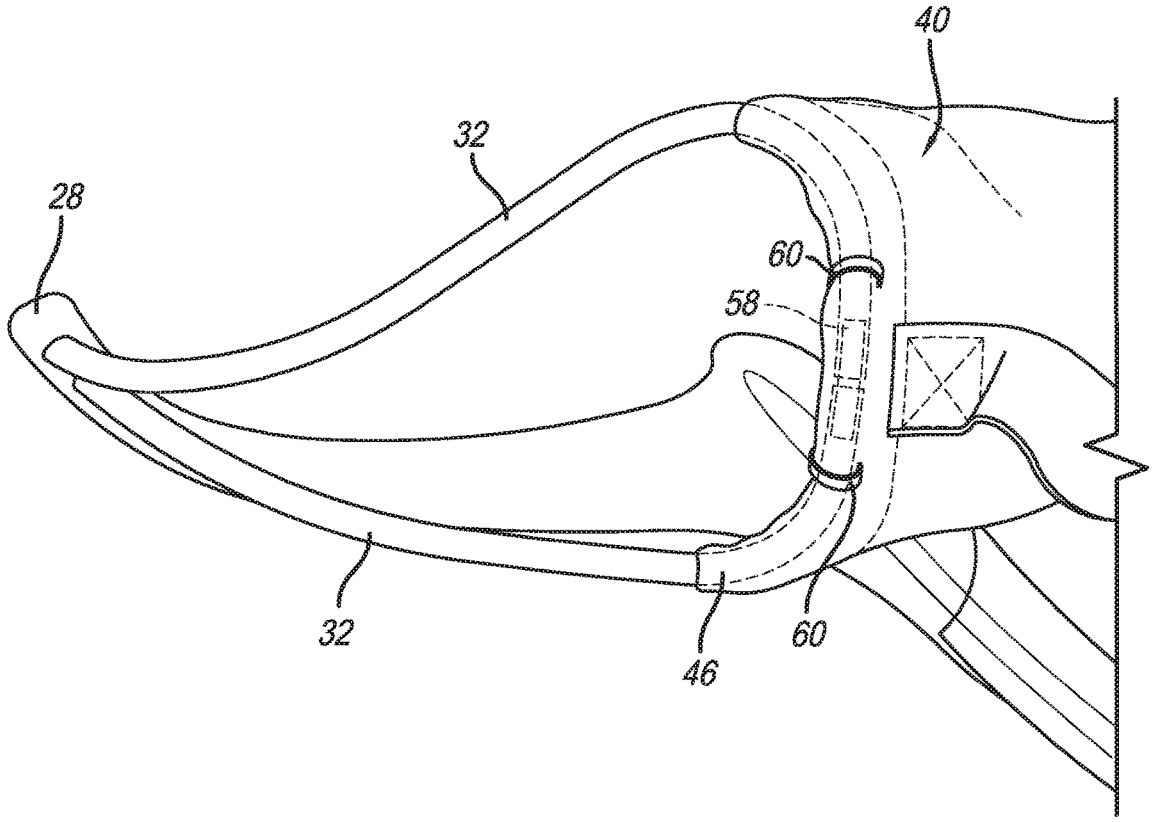
FIG. 5 is perspective view of a section of a launching device as disclosed herein featuring an attachment between a pouch and an elastomeric member.

FIG. 5 illustrates a portion of a launching device as disclosed herein featuring the connection between the elastomeric bands 32 or tubes and the pouch 40. In an example, a single length of an elastomeric tube or band may be used, wherein the band is placed through a respective pouch opening 46 that each of the ends may be disposed through the attachment features, e.g., openings, in the riser peripheral ends. The knots may be tied at each tube end to retain the tube in place so that it does not slip through the riser peripheral end openings when placed into a prelaunch state. In an example, the elastomeric bands 32 or tubes are hollow, and are attached with the riser peripheral ends 28 as discussed earlier so that the tube ends are connected together using a common fitting or element 58, e.g., a tubular element sized and configured to fit within each of the tube ends. If desired, a cement, adhesive, or sealing agent may be used to ensure that that each of the tube ends remain connected with the common fitting or element 58. If desired, attachment elements 60 may be used to retain placement of the common fitting 58 and tube end joint within the pouch opening 46. Such may be desired so as to minimize the chance of the elastomeric tube connection being severed due to pull force when band is stretched back, or otherwise damaged or interfered with by a user in a manner that may cause the tube ends to become loosed or removed. In an example, the attachment elements 60 may be provided in the form of clamps of the like positioned around portions of the tube ends downstream from the connector within and through the pouch so as to maintain the position of the connector within the opening 46. This is but one example of elements that may be used for this purpose and it is to be understood that all other elements that may be used to perform the same function are within the scope of the device as disclosed herein.

As noted above, the first structural element risers 24, 26 are configured to extend in a forward manner outwardly and away from respective ends of the handle 16 to the respective riser peripheral ends. FIG. 6A illustrates an embodiment of the device as disclosed and illustrated above, wherein each of the risers project in a forward direction away from the handle having a relatively constant angle of departure extending from the handle to each of the respective riser peripheral ends.

Figure 6B:
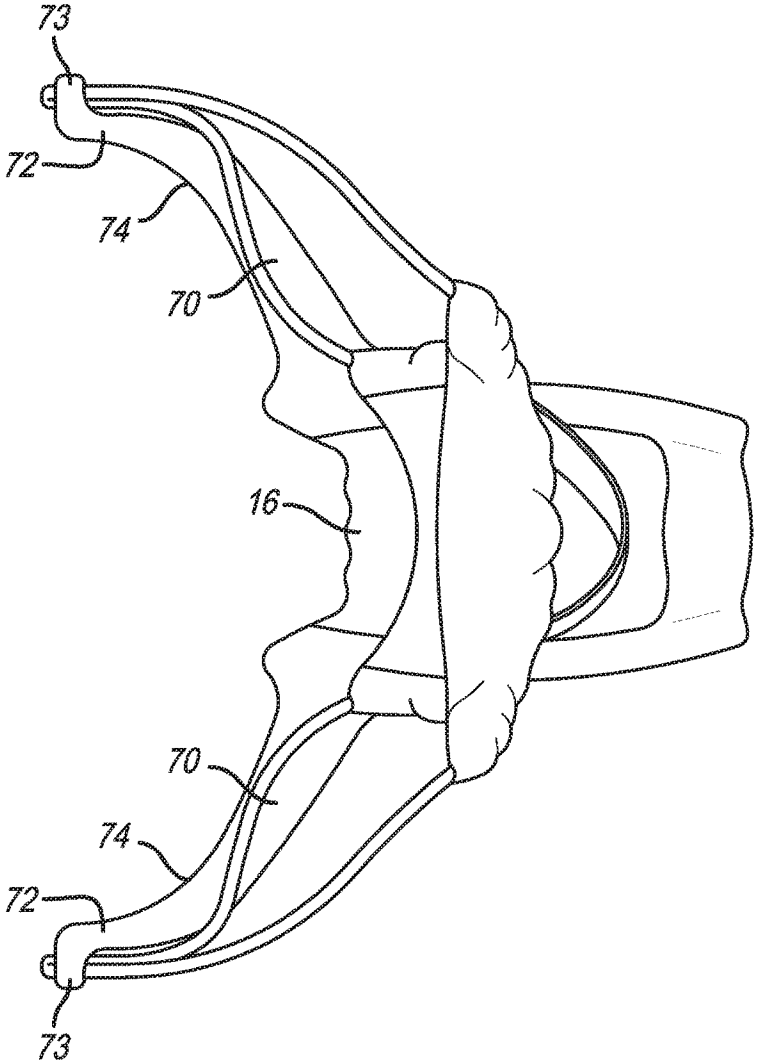
FIGS. 6A and 6B are side views of different launching device embodiment as disclosed herein having differently-configured riser elements.
Figure 6A:
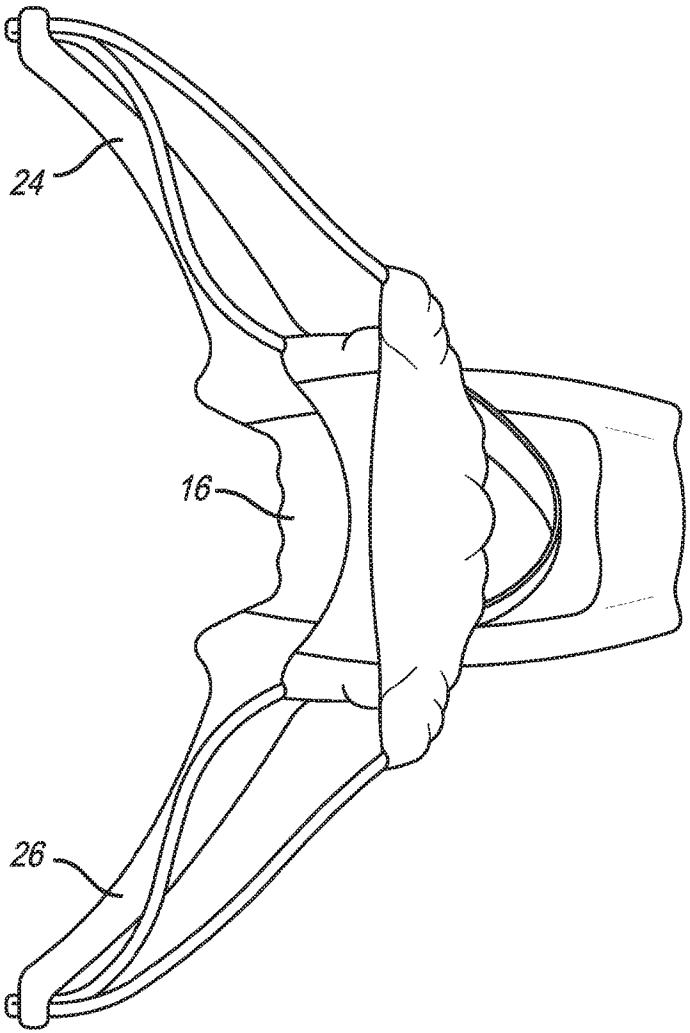

In contrast, FIG. 6B illustrates an embodiment of the launching device configured differently; namely, one where the risers have a compound configuration of two distinct angles of departure. While this example illustrates risers each having sections with two distinct angles of departure relative to the handle, it is to be understood that launching devices as disclosed herein may have risers each configured having segments characterized by two or more different angles of departure. In this particular example, a first riser section 70 extends from an end of the handle 16 a distance to a second riser section 72, wherein the first riser section 70 has a first angle of departure, and the second riser section 72 has a second angle of departure as taken relative to an axis running parallel running through the handle between handle ends. The second riser section 72 extends from the first riser section 70 to a respective riser peripheral end 73. A transition section 74 is interposed between the first and second riser sections 70 and 72 at the inflection point between the different angles of departure between the first and second riser sections. In an example, the first riser section 70 has an angle of departure relative to the handle 16 that is less than that of the second riser section 72 (again as measured relative to an axis passing in a parallel manner through the handle as described above).

In an example, the angle of departure of the first riser section 70 may be from about 30 to 90 degrees, 40 to 80 degrees, 50 to 70 degrees, and in a particular example about 60 degrees. The angle of departure of the second riser section 72 may be from about 40 to 90 degrees, 50 to 90 degrees, 60 to 80 degrees, and in a particular example about 80 degrees. In example, the riser first section 70 has a length that is relatively longer than the riser second section 72. In an example, launching devices as disclosed herein configured in the manner illustrated in FIG. 6B may provide certain advantages such as a more compact device packaging. Additionally, such launching device embodiment (as contrasted with the embodiment of FIG. 6A) has an increased degree of forward arc that results in a longer pull and greater energizing of the elastomeric bands to provide increased launching velocity and greater distance of travel for the launched object. Additionally, the example launching device illustrated in FIGS. 6A and 6B may also provide an improved degree of strength as the risers may, in addition to having a greater degree of angular deflection from the handle, be configured having a thicker cross-section to help resist flex during retraction of the pouch into launch state where the elastic bands are stretched and energized.

Figure 7:
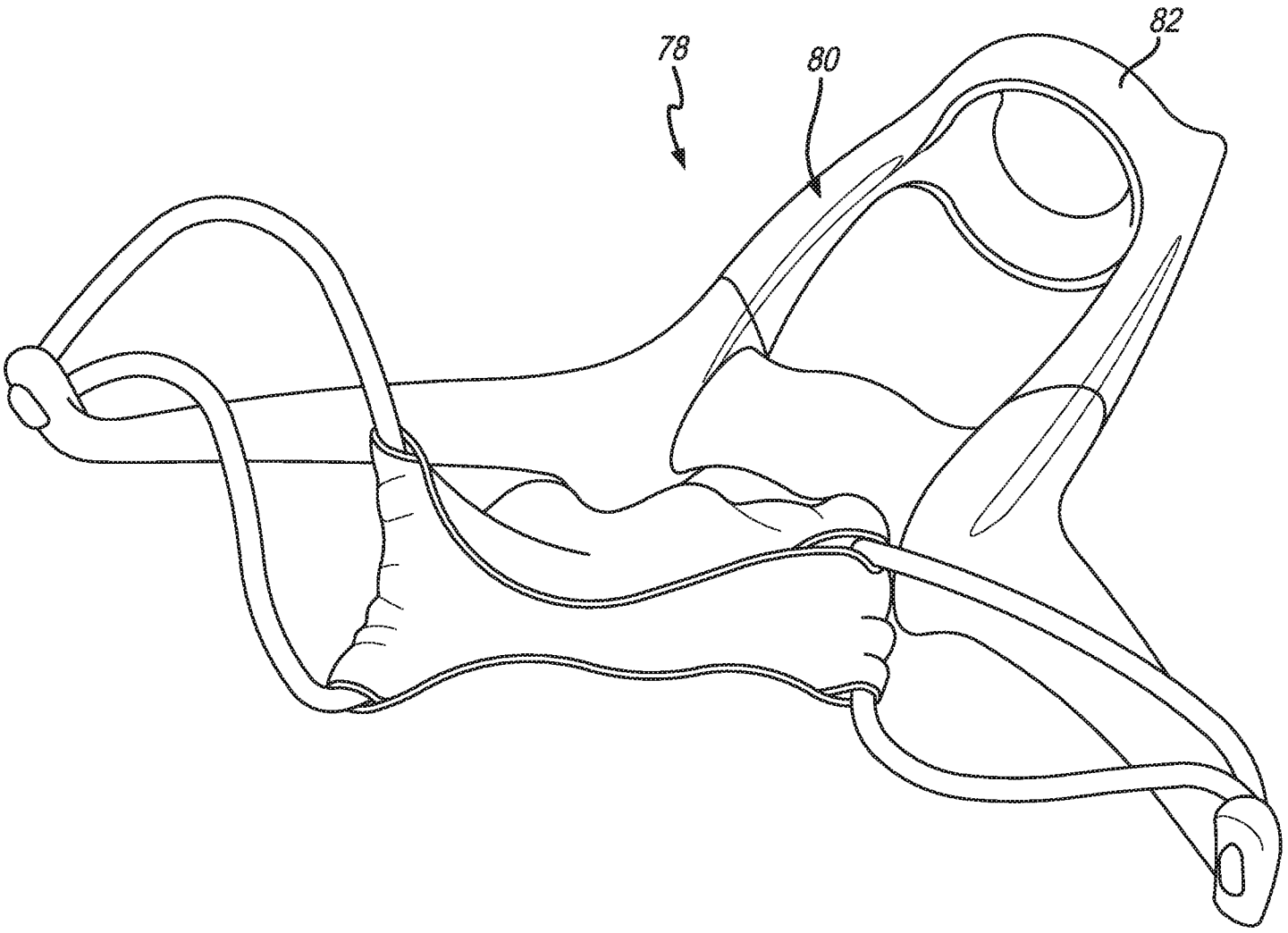
FIG. 7 is a perspective view of a launching device as disclosed herein.

As disclosed and illustrated above, the second structural element 50 comprises a supporting member. FIG. 7 illustrates an embodiment of a launching device 78 where the second structural element 80 comprises a supporting member 82 that is configured to surround a portion of a user's forearm. Such an embodiment may be useful to provide an additional level of support and stability to the launching device for a user, e.g., in a case where the grip strength of a particular user may be weak, to result in an additional level of accuracy in launching an object from the launcher to hit an intended target. Additionally, such embodiment of the launcher will enable a user to allow the launcher to hang from the users arm, e.g., so it does not have to be set down and then picked up, while using both hands to handle a water balloon and position the water balloon into pouch for launching.

Figure 8:
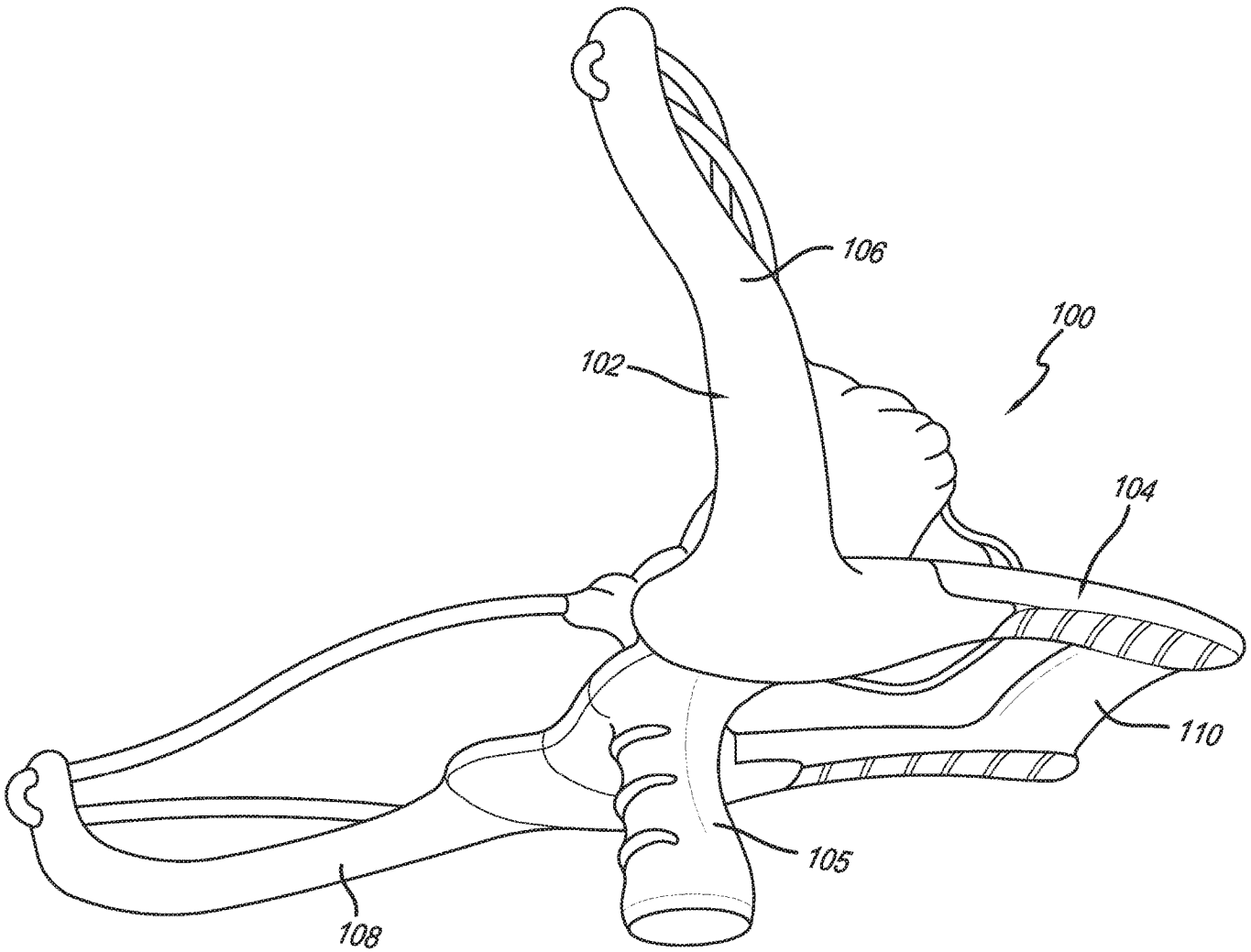
FIG. 8 is a perspective view of a launching device as disclosed herein.

FIG. 8 illustrates an embodiment of a launching device 100 as disclosed herein that is configured for horizontal use. The launching device 100 comprises a first structural element 102 and a second element 104 as disclosed and illustrated above, except that the first structural element 102 comprises a handle 105 that projects downwardly in a perpendicular fashion relative to the risers 106, 108 to enable a user to grasp the handle 105 in their hand when using the device in a horizontal manner to launch objects therefrom. In such embodiment, the second structural element 105 may comprise a support member 110 as disclosed and illustrated above and in FIGS. 1 to 4, or may use the support member as described above and illustrated in FIG. 7 to provide an improved degree of stability and control.

Figure 9A:
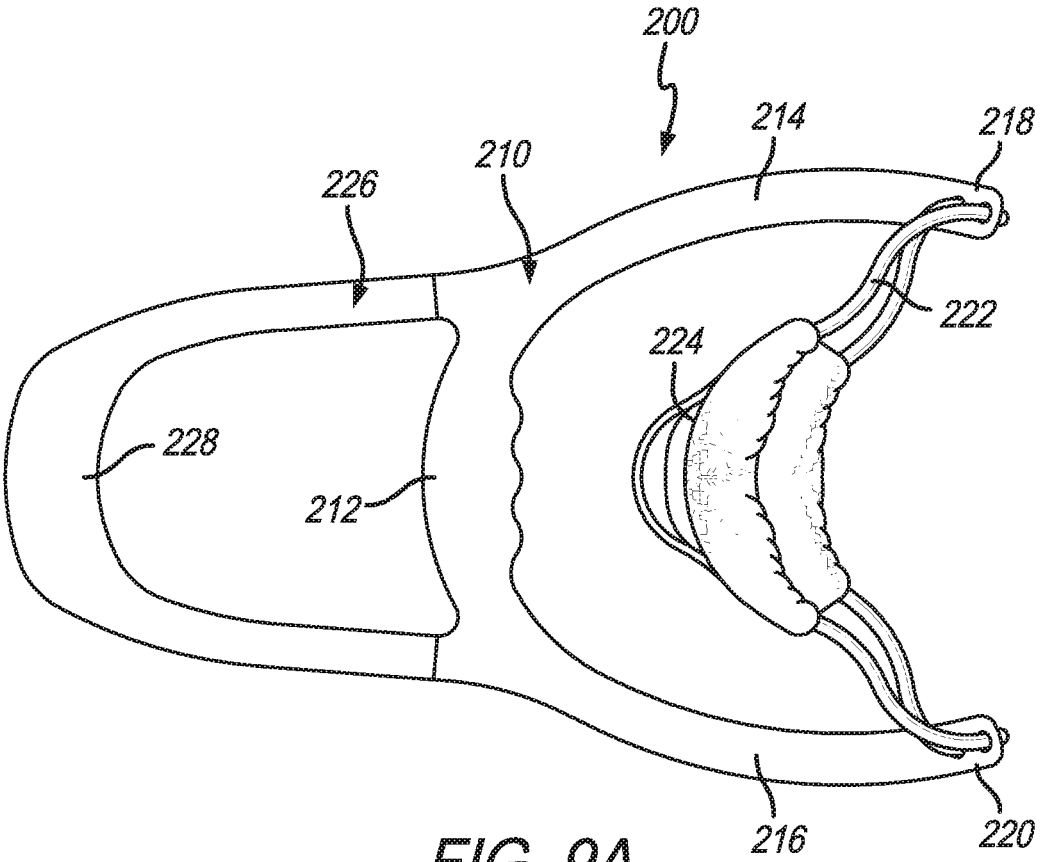
FIGS. 9A and 9B are respective top and side views of a different embodiment launching device as disclosed herein.
Figure 9B:
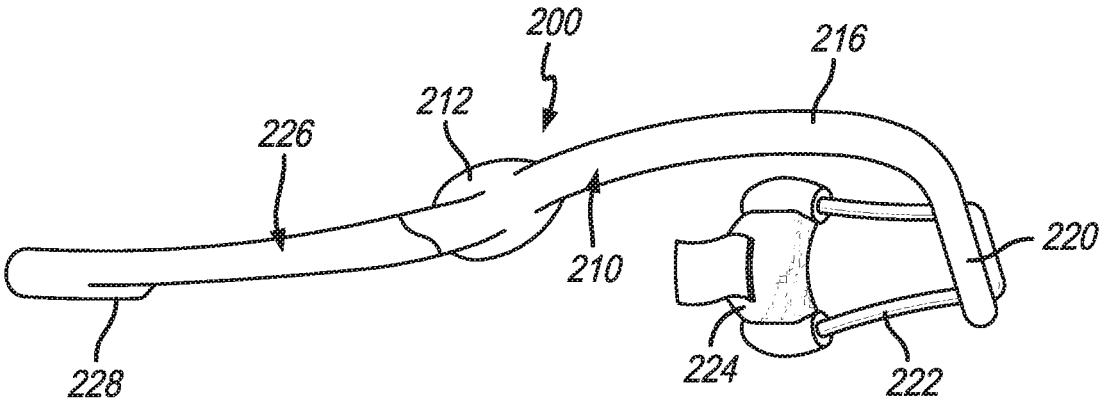

FIGS. 9A and 9B illustrate another example launching device 200 as disclosed herein that has a relatively compact configuration, as compared to the launching devices disclosed and illustrated above. In an example, the launching device 200 has a first structural element 210 comprising a handle 212 and a pair of risers 214 and 216 extending away from opposed handle ends. A feature of this example is that the risers 214, and 216 project in a frontward manner from the handle at an extreme angle of departure relative to an axis running parallel through the handle. In an example, the angle of departure may be from about 60 to 90 degrees, about 70 to 85 degrees, and in a particular example approximately 80 degrees. In the illustrated example, the risers have an arc configuration characterized by a generally continuous radius of curvature, however may alternatively be configured having two or more riser segments each with a different radius of curvature. Thus, configured in this manner, the risers 214 and 216 project in a generally aggressive forward-directed manner away from the handle 212.

In an example, each riser may have a length that is between about 0.5 to 3 times, 1 to 2.5 times, and 1.5 to 2 times the length of the handle. The launching device 200 may have a riser tip-to-tip dimension, as measured between riser peripheral ends 218 and 220, that is between about 1 to 3 times the handle length, from about 1.5 to 2.5 the handle length, and in a particular example approximately 2 times the handle length. A feature of such launching device configured in this manner is that it enables the elastomeric bands 222 to be stretched and energized within a relatively short pull distance, i.e., shorter pull back distance, when compared to a pull distance of the other launching device embodiments, to provide a desired launching force useful for launching the object a desired distance to a target. Thus, a feature of such launching device example, in addition to being more compact in configuration, is that it may deliver a launched object the same or a greater distance as the other launching device embodiments and do so with a shorter pull back distance.

As with the other launching devices disclosed herein, the launching device 220 may comprise elastomeric bands 222 configured as dual bands from the respective riser end to the pouch 224 or as a single band. Additionally, while the launching device 200 as illustrated comprises a second structural element 226 having a support member 228 as described above and illustrated in FIGS. 1 to 4, the launching device 200 may be configured having the support member as disclosed above and illustrated in the example of FIG. 7, e.g., that surrounds the a forearm portion of a user. Also, if desired, launching device 200 may be configured comprising a handle as disclosed above and illustrated in the example of FIG. 8, e.g., to enable horizontal positioning and use of the launching device. Further, such launching device 200 may be configured having one or both of the different support member and/or handle as described above.

Figure 10A:
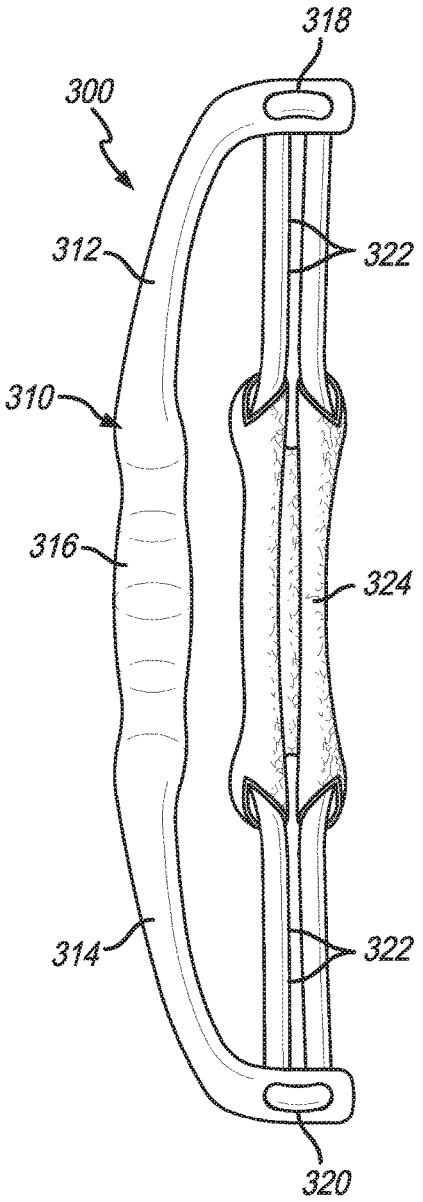
FIGS. 10A and 10B are respective front and side views of a different embodiment launching device as disclosed herein.
Figure 10B:
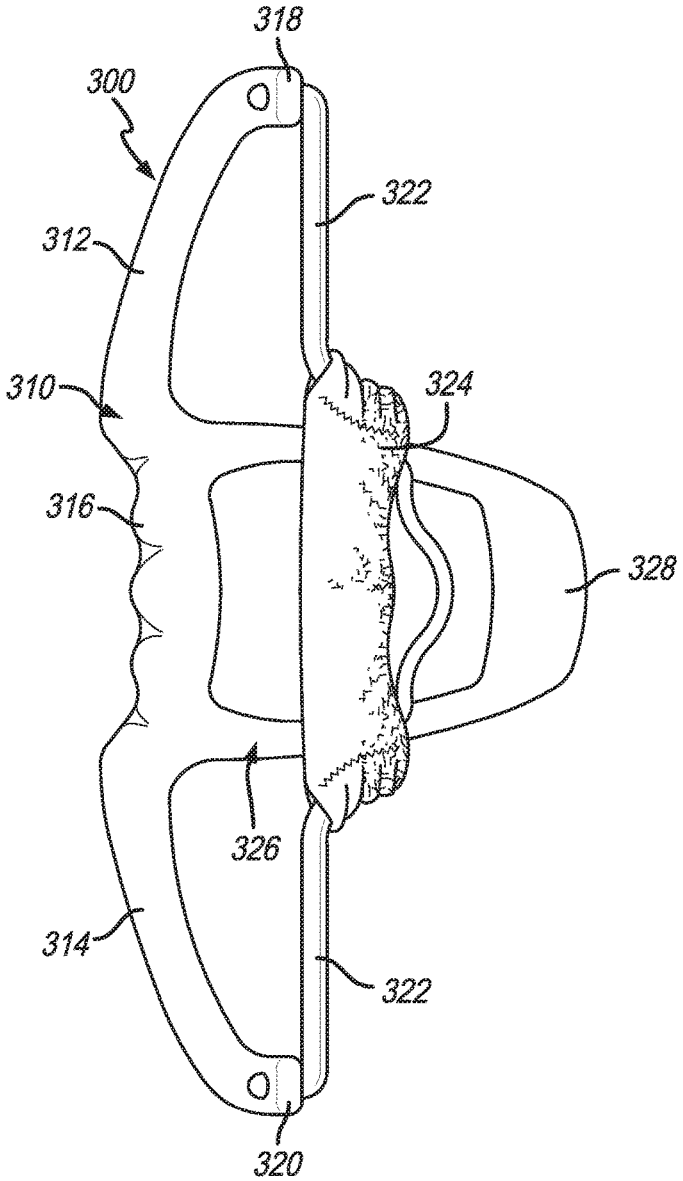

FIGS. 10A and 10B illustrate views of an alternative embodiment launching device 300 as disclosed herein that is different from the embodiments described and illustrated above in that it comprises a first structural element 310 having risers 312 and 314 that extend outwardly from opposed ends of the handle 316 in a rearward-directed angle of departure, rather than in a forward angle of departure relative to the handle. The risers 312 and 314 in this example extend outwardly in opposite directions from opposed ends of the handle 316 and each sweep in a rearward direction relative to the handle moving from the handle ends to respective peripheral riser ends 318 and 320. In an example, the risers 312 and 314 may extend in a rearward direction having an angle of departure, as measured relative to an axis running parallel through the handle between handle ends, of from about 0 to 90 degrees, 15 to 75 degrees, 30 to 60 degrees, and in a particular example approximately 30 degrees. Additionally, as with the examples described above, the peripheral ends of each riser extend outwardly in a manner perpendicular to each respective riser for purposes of providing a desired degree or distance of clearance between the handle and pouch 324, to ensure that the pouch and its contents do not hit the handle during a launch operation. The launching device 300 includes elastomeric bands 322 and the pouch 324 as disclosed above in the earlier embodiments.

Referring to FIG. 10B, the launching device 300 also includes a second structural element 326 connected with the first structural element 310 adjacent the handle 316, and extending in a rearward direction therefrom to a support member 328 configured for resting against a forearm portion of a user during operation of the device. Also, the launching device 300 may make use of a support member configured as illustrated in FIG. 7 to surround a portion of the user's arm.

Launching devices as disclosed herein are specially configured for use by a single person for the purpose of launching a desired object, such as a water balloon, a distance towards an intended target. In an example, such devices are operated by a user grasping the handle in one of their hands and placing the desired object, such as a water balloon, into the pouch and raising to a position where the pouch and its contents may be drawn away from the device into a prelaunch position where the elastomeric bands are placed into an energized state. Once the device is aimed at a desired target by the user it is activated for launching the object within the pouch by releasing the pouch, thereby causing the elastomeric bands to be contracted and causing the pouch and its contents to pass beyond the handle and risers and be released from the pouch once the elastomeric bands are tensioned restricting further pouch travel. As noted above, devices as disclosed herein may be configured to permit use in a vertical orientation or a horizontal direction.

Although only a few example embodiments have been described in detail above, those skilled in the art will readily appreciate that many modifications are possible in the example embodiments without materially departing from the concepts as disclosed herein. For example, while launching devices disclosed and illustrated herein make use of a second structural element with a support member, it is to be understood that such second structural element may be optional and that launching devices may be configured without such second structural element, and such embodiment is understood to be within the scope of launching devices as disclosed herein.

Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A device for launching objects comprising:

a bow comprising:

a first structural element comprising a handle positioned along a middle section of the element, and first and second risers extending outwardly from opposed ends of middle section;

a second structural element extending outwardly and away from the middle section and having a support member at an end of the second structural member, the support member being positioned to rest against a forearm of a user when the user grasps the bow handle in their hand;

a pouch that is movably attached to the bow and that is configured to accommodate placement of a desired object to be launched therein; and one or more elastomeric bands attaching the pouch to the bow;

wherein the device is placed into a first energized position when the pouch is pulled away from the bow to energize the one or more elastomeric bands, and the device is placed into a second released position when the pouch is released, thereby causing the pouch and its contents to accelerate towards the bow and to release the contents after movement of the pouch has been restrained by the one or more elastomeric bands.

2. The device as recited in claim 1 wherein the first and second risers project in a frontward direction away from the middle section.

3. The device as recited in claim 1 wherein the first and second risers project in a rearward direction away from the middle section and towards the support member.

4. The device as recited in claim 1 wherein the support member is configured to surround a forearm portion of a user's arm.

5. The device as recited in claim 1 wherein the handle extends in a perpendicular direction relative to the first and second risers.

6. The device as recited in claim 1 wherein the first and second risers project in a frontwards direction away from the handle having a degree of departure of from about 60 to 90 degrees as measured relative to an axis running parallel through the middle section between the risers.

7. The device as recited in claim 1 wherein the peripheral ends of each of the first and second risers are turned outwardly away from the handle a distance sufficient for the pouch to clear the handle when the device is moved from a first to second position, and wherein the first and second peripheral riser ends are configured with attachment points for the one or more elastomeric bands.

8. A device for launching objects comprising:

a bow comprising:

a first structural element comprising a handle positioned along a middle section of the element, and first and second risers extending outwardly in respective opposed directions from opposed ends of the middle section, wherein each of the first and second risers include first and second sections that have different angles of departure relative to one another;

a second structural element extending outwardly and away from the middle section in a direction opposite from the first and second risers, the second structural element including a support member positioned to rest against a portion of a user's arm when the user grasps the bow handle in their hand;

a pouch that is connected with the bow; and a pair of elastomeric bands each extending between the pouch and a respective peripheral ends of the first and second risers.

9. The device as recited in claim 8 wherein the second structural element comprises a pair of arms that extend from the middle section to the support member, and wherein the support member is interposed between the pair of arms.

10. The device as recited in claim 8 wherein the first and second risers project away from the middle section in a forward direction and have a degree of departure of from about 60 to 90 degrees as measured relative to an axis running parallel through the middle section.

11. The device as recited in claim 8 wherein the first and second risers project away from the middle section in a rearward direction towards the support member the pouch is formed from a fabric material and includes two opposed edge sections that are configured to accommodate connection with a respective elastomeric band.

12. The device as recited in claim 8 wherein the object to be launched is a water balloon, the water balloon is disposed within the pouch, and wherein the pouch is configured to accommodate about 50 percent or more of the total surface area of the water balloon.

13. The device as recited in claim 8 wherein the support member is configured to surround a forearm portion of a user's arm.

14. The device as recited in claim 8 wherein the handle extends downwardly from the middle section perpendicular to the risers.

15. A method for launching a water balloon comprising the steps of:

placing a water balloon into a pouch for accommodating at least partial placement of the water balloon therein, wherein the pouch is connected by elastomeric bands to a bow comprising a first structural element having a handle and first and second risers extending outwardly in opposite directions from opposite ends of a middle section of the first structural element, the elastomeric bands being attached to peripheral ends of the respective first and second risers;

grasping the handle of the bow in one hand such that a support member that is attached to a second structural element extending from the handle contacts a portion of the same arm that is used to grasp the handle;

pulling the pouch away from the handle so as to energize the elastomeric bands and place the pouch and water balloon contained therein into a lunching position; and releasing the pouch to cause the pouch and the water balloon to be launched outwardly and away from the bow by the released elastomeric force of the elastomeric band.

16. The method as recited in claim 15 wherein the handle extends downwardly from the first structural element perpendicular to the risers.

17. The method as recited in claim 15 wherein the handle includes a support member surrounds a portion of the arm used to grasp the handle.

18. The method as recited in claim 15 wherein the first and second risers extend from the middle section of the first structural element in a frontward direction away from the second structural element.

19. The method as recited in claim 15 wherein one of the first and second risers first and second sections have an angle of departure of from about 60 to 90 degrees relative to the axis running through opposed ends of the first structural element middle section.

20. The method as recited in claim 15 wherein the first and second risers extend from the middle section of the first structural element in a rearward direction towards the portion of the second structural element that contacts the arm.

* * * * *